United States Patent [19]

Sanford et al.

[11] 4,011,422

[45] Mar. 8, 1977

[54] PUSH-BUTTON SWITCH

[75] Inventors: Carlton E. Sanford, East Providence, R.I.; Laurence P. Kleven, South Attleboro, Mass.

[73] Assignee: Texas Instruments Incorporated, Dallas, Tex.

[22] Filed: Mar. 3, 1975

[21] Appl. No.: 554,385

[52] U.S. Cl. ..... 200/159 B; 200/276; 200/52 R

[51] Int. Cl.[2] ..... H01H 3/12

[58] Field of Search ..... 200/159 R, 159 A, 159 B, 200/83 N, 276, 61.76, 85 R, 61.45 R, 83 R, 314, 52 R; 58/85.5, 50 R, 23 BA

[56] References Cited

UNITED STATES PATENTS

| | | | |
|---|---|---|---|
| 884,121 | 4/1908 | Apold | 200/85 R |
| 2,916,871 | 12/1959 | Wegner | 58/50 R |
| 3,767,875 | 10/1973 | Schneikart et al. | 200/52 R |
| 3,946,182 | 3/1976 | Holder | 200/159 B |

*Primary Examiner*—Robert K. Schaefer
*Assistant Examiner*—Morris Ginsburg
*Attorney, Agent, or Firm*—Harold Levine; John A. Haug; James P. McAndrews

[57] ABSTRACT

A push-button switch having an electrically conductive body forming a chamber, having a fixed contact supported in the chamber, having a passage communicating with the chamber, having a flexible diaphragm sealing said chamber from said passage, and having an operating member slidably movable in said passage for depressing the diaphragm, has a flat spiral spring disposed within the chamber with the perimeter of the spring in electrical engagement with the body and with a central portion of the spring disposed in selected spaced relation to the fixed contact between the fixed contact and the diaphragm for permitting movement of the operating member to depress the central portion of the flat spiral spring through the flexible diaphragm into electrical engagement with the fixed contact to close an electrical circuit between the fixed contact and the body.

4 Claims, 6 Drawing Figures

PUSH-BUTTON SWITCH

Electrical digital displays provided in the electronic wrist watches tend to impose relatively heavy electrical loads on the battery power supplies used in such watches and accordingly, electrical switch means are desirably mounted on the watch case in a conveniently accessible location to permit selective actuation of the watch display only where reading of the display is required. Switch means utilized for this purpose should be extremely small to permit mounting of the switch in a readily accessible location without extending so far from the watch case that the switch would tend to be snagged on clothing and without requiring excessive space within the watch case. Such switch means should also be adapted for a very long cycle life, should be a normally open switch which freely returns to open position to assure that the switch is not inadvertently left in closed position for any extended period of time, should provide closing of a circuit without excessive resistance across closed switch contacts, should be sealed against the environment, should be easily sealed relative to a watch case, and should be formed of low cost materials and economically assembled.

It is an object of this invention to provide a novel and improved push-button switch; to provide such a switch which is of extremely small and compact size; to provide such a switch which is adapted to display a long cycle life, which is sealed against the environment, which is readily mounted in sealed relation to a watch case, and which is formed of low cost materials and adapted to be economically assembled; and to provide such a switch which is normally open and which freely returns to open position to assure that the switch is not inadvertently left in closed position for any extended period of time due to any sticking of components within the switch.

Other objects, advantages and details of the novel and improved push-button switch of this invention appear in the following detailed description of preferred embodiments of the invention, the detailed description referring to the drawings in which.

Figure 1:
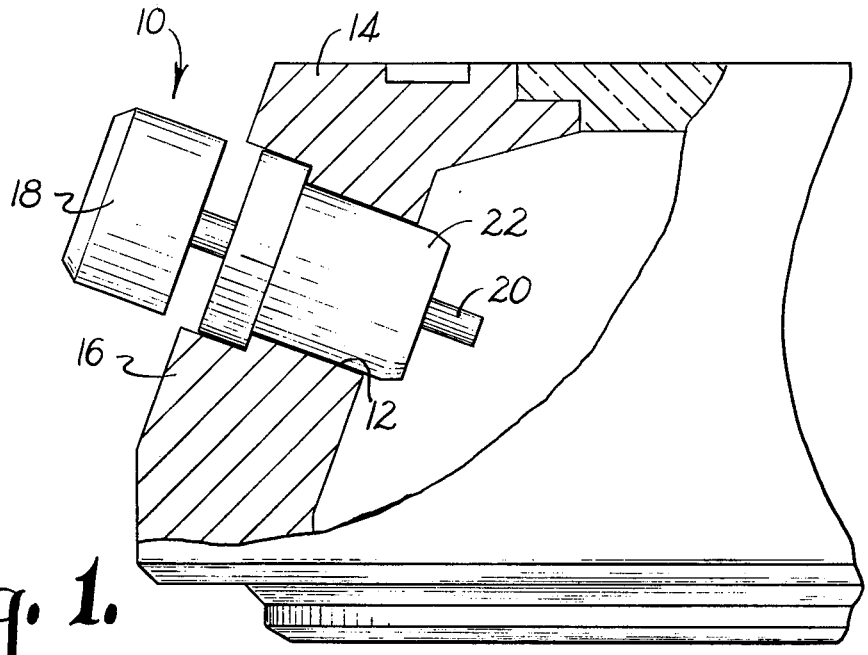
FIG. 1 is a partial side elevation view of a watch case partly cut away illustrating mounting of the switch of this invention.
Figure 2:
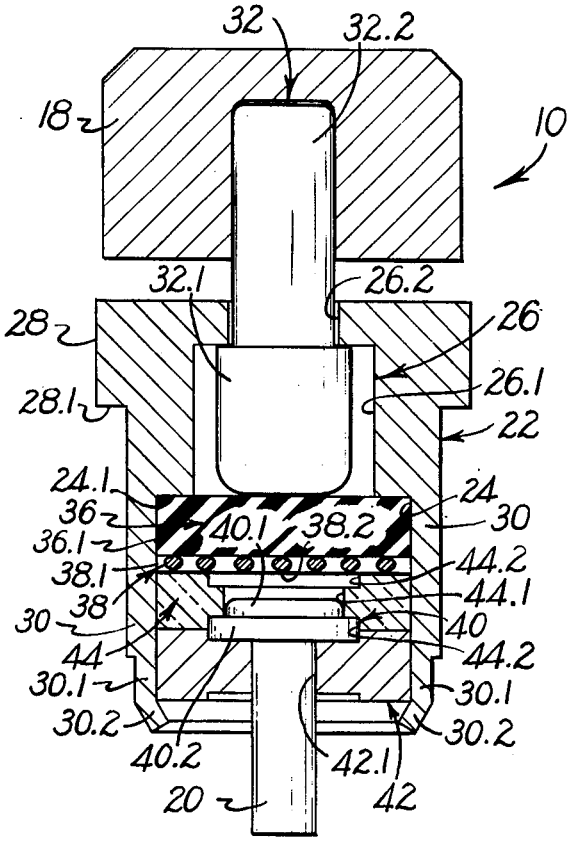
FIG. 2 is a section view along the longitudinal axis of the switch of this invention.
Figure 3:
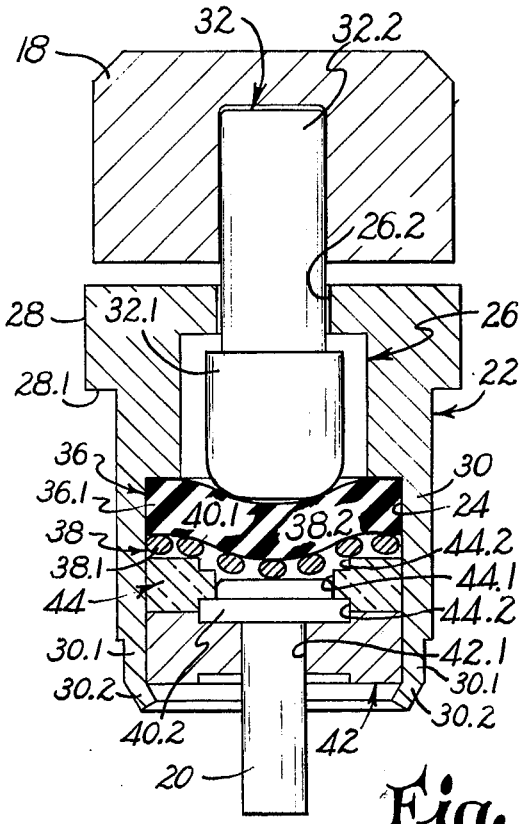
FIG. 3 is a section view similar to FIG. 3 illustrating an alternate position of the switch of FIG. 2.

Referring to the drawings, 10 in FIGS. 1–3 indicates the novel and improved push-button switch of this invention which is shown to be mounted in an aperture 12 in the side of a watch case 14, the watch case being provided with a slight slope on an outer surface 16 and the switch 10 being sufficiently small and compact to be mounted at the location of this sloping case surface with a push-button 18 at one end of the switch disposed to be accessible from the watch exterior and with a switch terminal 20 extending conveniently into the interior of the watch case. As will be understood, the terminal 20 is positioned to be connected to electrical circuitry (not shown) inside the watch case for permitting selectively energization of a digital watch display. Of course, the switch of this invention is adapted for use in other applications but is particularly adapted for actuation of a digital watch display as shown.

As shown, particularly in FIGS. 2 and 3, the switch 10 of this invention includes a generally cylindrical, electrically conductive body 22 preferably formed of brass or steel or the like having an open-ended chamber 24 formed at one end of the body and having a passage 26 communicating with the chamber 24 from the opposite end of the body. Preferably as shown, the passage 26 includes a relatively larger diameter portion 26.1 adjacent the chamber 24 and a relatively smaller diameter portion 26.2 at said opposite end of the body. Preferably also the body is provided with a flange 28 forming a shoulder 28.1 at said opposite body end. As shown, the open-ended chamber 24 is large relatively to the body diameter so that the chamber walls 30 are relatively thin and if desired, these walls 30 are made even thinner immediately adjacent to the open chamber end as indicated at 30.1. As will be understood, the body 22 is particularly adapted for very low cost manufacture on a screw machine or the like. As shown, the switch 10 also includes an operating member 32 which is freely slidable for at least a limited degree of axial movement in the body passage 26, the operating member having a relatively large diameter portion 32.1 in the larger diameter portion 26.1 of the passage and a stem portion 32.2 extending out of the smaller passage portion 26.2. In this arrangement, a push-button cap 18 is readily secured to the stem 32.2 of the operating member by press-fitting or cementing or in other convenient manner.

In the switch 10, a flexible diaphragm 36, preferably formed of any suitably pliable and slightly compressible elastomer such as ethylene propylene is disposed within the open-ended chamber 24 to rest against the shoulder 24.1 of the chamber with the perimeter 36.1 of the diaphragm preferably resting against the walls 30 of the chamber. A fixed contact member 40 is also preferably mounted within the open-ended chamer 24 in electrically insulated relation to the body 22 by use of electrically insulating spacer means 42 and 44. That is, the fixed contact member 40 is preferably provided with a contact surface portion 40.1 of selected diameter upstanding from a relatively larger diameter flange portion 40.2 of the contact, the fixed contact preferably being formed integral with the switch terminal 20 which extends axially and longitudinally from the flange portion of the contact. As can be seen, the fixed contact 40 is thus adapted for convenient and inexpensive manufacture by screw machine or the like. The spacer means 42 is provided with a central opening 42.1 to fit over the terminal 20 and the spacer 44 has a similar central opening 44.1 provided with a counterbore 44.2 at each end of this central opening. The spacer 44 is then fitted over the fixed contact with one counterbore 44.2 fitted over the flange portion 40.2 of the fixed contact to align the central opening 44.1 to permit clear access to the contact surface portion 40.1 of the fixed contact. Preferably, the spacer means 42 and 44 are formed by molding a relatively rigid thermoplastic material such as glass-filled nylon or glass-filled acrylonitrile butadiene styrene (ABS) or the like. As thus far described, the switch 10 is substantially as described in the commonly assigned copending application of Sanford, Ser. No. 554,386.

Figure 4:
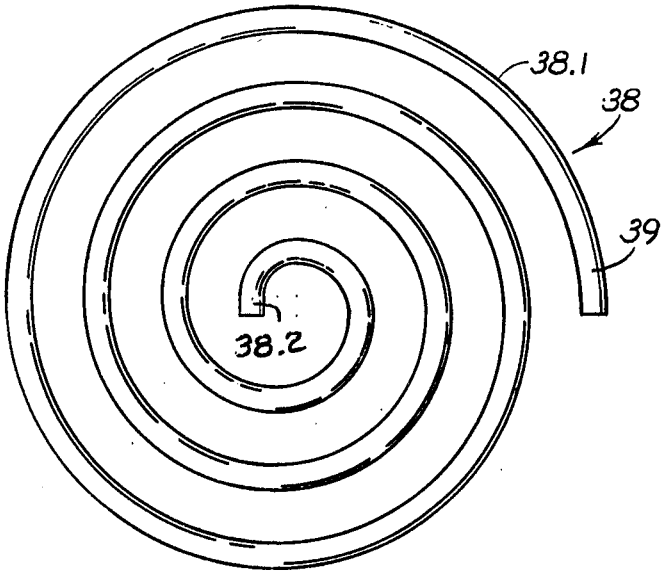
FIG. 4 is an enlarged plan elevation view of a component of the switch of FIG. 2.
Figure 5:
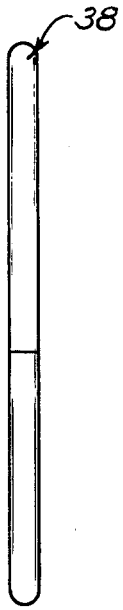
FIG. 5 is a side elevation view of the component shown in FIG. 4.

In accordance with this invention, however, a flat spiral spring element 38 is then disposed within the chamber 24 to rest on the diaphragm to serve as a movable switch contact. Preferably, as is best shown in FIGS. 3 and 4, the spring 38 is wound from conventional round spring wire 39 on conventional spring coiling equipment and is then flattened on the edges of the round wire along the outer surface of the flat spiral spring by coining or stamping to provide the spring structure illustrated in FIGS. 3 and 4. Desirably, the spring is formed of copper or tin-plated stainless steel spring wire. In this arrangement, the spring 38 is proportioned so that when pressed into the chamber 24, the spring is radially compressed to a small extent so that the perimeter 38.1 of the spring is held firmly in electrical engagement with the walls 30 of the chamber 24.

In accordance with this invention, the thin walls portions 30.1 of the chamber 24 are then rolled inwardly of the chamber 24 as indicated at 30.2 for pressing the spacer means 42 and 44, the spring 38, and the diaphragm 36 securely into position within the chamber 24.

In this way, the switch 10 is provided with a very small and compact size and is adapted for convenient and inexpensive assembly. That is, after formation of the switch body in inexpensive manner, the operating member is conveniently positioned in the body passage 26. The diaphragm 36, and the spring 38 as well as the contact 40 and the spacers 44 and 42 are then inserted into the body chamber 24 in sequence and the walls 30.1 of the chamber are rolled inwardly. In this arrangement, the diaphragm 36 is compressed against the bottom 24.1 of the chamber 24 for sealing that end of the chamber from the passage 26. The perimeter of the spring 38 is also held firmly in position in electrical engagement with the walls 30 of the chamber and the central portion 38.2 of the spring is disposed in selected spaced relation to the contact surface portion 40.1 of the fixed contact, the fixed contact also being held securely in place within the chamber in electrically insulated relation to the body 22 with the spacers 42 and 44 being secured in sealing relation to the chamber walls 30 and to the fixed contact 40 for sealing the open end of the chamber 24. Accordingly, when the push-button cap 18 is manually depressed, the operating member 32 freely slides in the body passage 26 to flex the diaphragms 36 as shown in FIG. 2 and to move the center portion 38.2 of the flat spiral spring into firm electrical engagement with the contact surface 40.1 of the fixed contact, thereby to close an electrical circuit between the switch body 22 and the fixed contact. Upon release of the manual pressure on the push-button cap 18, the spring 38 and the diaphragm 36 return to their original normally open switch position as shown in FIG. 1 as a result of their inherent resilience and, because the operating member passage is sealed without requiring any sliding seal along the length of the operating member (as where an O-ring or the like might have been used to seal the passage 26), the operating member freely returns to its open circuit position. In this way, the spring contact 38 provides excellent, low resistance electrical engagement with the fixed contact 40 and is adapted to display an extremely long cycle life while providing complete ease in closing a circuit and while assuring that the switch freely returns to normally open circuit position when manual pressure on the switch is released. Further, various components of the switch including the diaphragm 36, the spring contact 38, and the spacers 42 and 44 are configured so that, as illustrated in the drawings, the components are mountable with either side in the illustrated disposition, thereby to facilitate assembly of the switch at low cost. The switch body 22 is also adapted to be easily pressfitted into a aperture in a watch case with the flange shoulder 28.1 of the body engaging a shoulder on the watch case for properly locating the switch on the case in sealed relation to the case.

Figure 6:
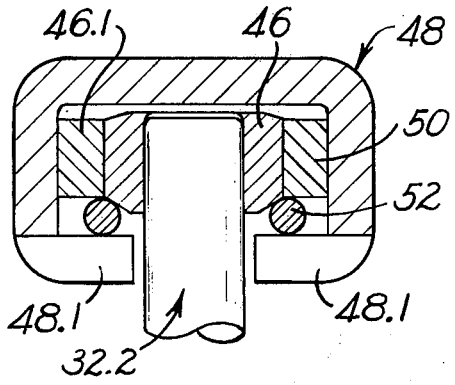
FIG. 6 is a partial section view similar to FIG. 2 illustrating an alternate embodiment of the switch of this invention.

In this latter regard, an alternate embodiment of the switch 10 as shown in FIG. 6 is desirably used for facilitating mounting of the switch 10 on a watch case. That is, as is shown in FIG. 6, in this alternate embodiment of the switch 10, the push-button cap 18 is omitted and a ferrule 46 is press-fitted or cemented onto the stem portion 32.2 of the switch operating member. After securing of the diaphragm, spring contact, spacer means and fixed contact of the switch in the switch body as above-described, the switch body 22 is pressfitted into the noted watch case aperture by applying pressure onto the flange portion 28 of the body. Then, after the switch body has been mounted on the watch case, an alternate cup-shaped push-button cap 48 is provided, this cap preferably being of a drawn steel or brass construction having a liner ring 50 pressed into the cap, having a C-shaped spring 52 or the like disposed within the cap, and having cap tabs 48.1 turned inwardly at the open end of the cup-shaped cap for retaining the spring within the cap. This cap structure is then mounted on the stem portion of the operating member by pressing the structure over the ferrule 46 so that the spring 52 is spread apart to fit over and to capture the ferrule for retaining the cap structure on the operating member. As shown the ferrule is preferably tapered as at 46.1 to facilitate this movement of the spring 52 over the ferrule, to permit the ferrule to be easily assembled with either side up, and to provide a sloping surface for engagement with the spring 52 to obviate any need for adjustment of the cap retention while assuring secure, rattlefree positioning of the cap on the operating member.

It should be understood that although preferred embodiments of the switch of this invention have been described by way of illustrating the invention, various modifications of the illustrated switch structure can be made within the scope of this invention. For example, other generally flat spring contact structures could be secured between the diaphragm 36 and the spacer means 42 and 44; and the spacer means could be formed as a single unit and could be formed of glass material heat-sealed into the open end of the switch body chamber 24. This invention includes all modifications and equivalents of the disclosed switch structure falling within the scope of the appended claims.

We claim:

1. A push-button switch comprising an electrically conductive body having a chamber and a passage communicating with the chamber, fixed contact means supported in the body chamber, a flexible diaphragm sealing said chamber from said passage, an operating member slidable in said passage to depress the diaphragm, and a flat spiral spring disposed within the chamber between said fixed contact means and diaphragm with the perimeter of the spring in resilient electrical engagement with the body and with a central portion of the spring disposed in selected spaced relation to the fixed contact means permitting sliding movement of the operating member to depress the central portion of the spring through the sealing flexible diaphragm into electrical engagement with the fixed contact means to close an electrical circuit between the body and the fixed contact means.

2. A push-button electrical switch comprising an electrically conductive body having a chamber formed within the body open at opposite ends of the body, a fixed electrically conductive contact, electrically insulating spacer means secured in the body chamber sealing one end of the body chamber and supporting the fixed contact in electrically insulated relation to the body extending from the body chamber, a flat resilient spiral spring of electrically conductive material disposed within the body chamber on the spacer means with the perimeter of the spring in resilient electrical engagement with the body and with a central portion of the flat spiral spring disposed in selected spaced relation to the fixed contact, an elastomer diaphragm secured within the body chamber sealing the opposite end of the body chamber, and an operating member slidably mounted on the body to be manually pressed for selectively pressing the diaphragm to move the central portion of the flat spiral spring into electrical engagement with the fixed contact to close an electrical circuit between the fixed contact and the electrically conductive body.

3. A push-button switch as set forth in claim 2 wherein said spring perimeter resiliently electrically engages said body within said body chamber and said spring perimeter is secured in said electrical engagement with said body between said diaphragm and spacer means.

4. A push-button switch as set forth in claim 3 wherein said flat spiral spring is coined over each flat surface of the spring structure.

* * * * *